United States Patent [19]

Ludwig et al.

[11] Patent Number: 4,550,036

[45] Date of Patent: Oct. 29, 1985

[54] ELECTROLESS SILVER PLATING PROCESS AND SYSTEM

[75] Inventors: Frank A. Ludwig, Rancho Palos Verdes; Carlyle L. Helber, Jr., Fountain Valley, both of Calif.

[73] Assignee: Hughes Aircraft Company, El Segundo, Calif.

[21] Appl. No.: 662,110

[22] Filed: Oct. 18, 1984

[51] Int. Cl.[4] ..... B05D 1/18

[52] U.S. Cl. ..... 427/443.1; 118/400; 118/429; 118/602; 118/603; 427/125; 427/437

[58] Field of Search ..... 118/602, 603, 400, 429; 427/125, 437, 443.1

[56] References Cited

U.S. PATENT DOCUMENTS

| | | | |
|---|---|---|---|
| 2,938,805 | 5/1950 | Agens | 106/1 |
| 2,966,408 | 3/1957 | Land | 96/29 |
| 3,261,711 | 7/1966 | Sallo | 118/602 X |
| 3,396,042 | 8/1968 | Duva | 106/1 |
| 3,817,774 | 6/1974 | Kuzmik | 117/47 A |
| 4,152,467 | 5/1979 | Alpaugh et al. | 427/443.1 X |
| 4,232,060 | 11/1980 | Mallory | 427/98 |
| 4,293,592 | 10/1981 | Morishita et al. | 427/98 |
| 4,355,083 | 10/1982 | Feldstein | 428/621 |
| 4,388,351 | 6/1983 | Sawyer | 427/304 |

*Primary Examiner*—James R. Hoffman

*Attorney, Agent, or Firm*—M. E. Lachman; A. W. Karambelas

[57] ABSTRACT

An improved electroless silver plating process in which the plating rate and plating texture are controlled by regulating the oxygen content of the active electroless silver plating solution. An active electroless silver plating solution is continually removed from the plating zone and exposed to a sufficient amount of an oxygen-containing gas to provide a stabilized silver solution. The stabilized silver solution is then extracted, filtered, replenished with desired chemicals, stored or otherwise handled prior to being recycled back to the plating zone. Prior to the stabilized silver solution being passed back to the plating zone, the stabilized solution is scrubbed in a scrubber zone with a gas capable of displacing oxygen from the stabilized solution to produce an active electroless silver plating solution. The plating rate and surface texture of the plated silver layer are controlled in part by regulating the amount of oxygen removed from the stabilized solution prior to passage through the plating zone.

10 Claims, 2 Drawing Figures

ELECTROLESS SILVER PLATING PROCESS AND SYSTEM

BACKGROUND OF THE INVENTION

1. Field of the Invention

The present invention relates generally to electroless silver plating processes and systems based upon the autocatalytic plating of silver onto various substrates. More particularly, the present invention relates to a process involving the control of the amount of oxygen in the electroless silver plating solution to provide a stabilized solution which is regenerated to the active plating solution by partially removing the oxygen with a scrubber gas, immediately prior to the plating process. The rate of autocatalytic silver deposition and the physical characteristics of the resulting silver plating is controlled in part by the oxygen content of the active electroless silver plating solution.

2. Description of the Related Art

Electroless plating is based upon the autocatalytic or spontaneous decomposition of a metal compound in a plating solution to provide deposition and plating of the metal onto a particular substrate which is immersed in the solution. Electroless nickel plating processes and electroless copper plating processes are well known and commercially widely used. Processes for electroless plating of gold, platinum, palladium and silver are also well known.

Electroless silver plating has particular application to the plating of passive microwave components. Passive microwave components are fabricated by machining, casting, dip brazing, electroforming or resin composite methods. The materials used are aluminum, invar (a nickel-iron alloy), and other metal and resin composites. Generally these components are silver electroplated to improve the Quality Factor (Q Factor) of the device, which is a measure of how well the device performs as a microwave cavity. The electrical performance or Q Factor of passive microwave components is directly related to the geometry of the component, surface smoothness, and the specific conductance of its energy propagating surfaces. To provide the desired electrical performance, the surfaces are typically silver electroplated to a thickness of between 100 to 1000 microinch (2.54 to 25.4 micrometers) depending on the energy frequency design of the component. Unfortunately, conventional electroplating does not deposit silver uniformly onto all the component surfaces. External surfaces rapidly build up a silver layer while internal, recessed surfaces are barely covered. The result can be a detrimental change of critical dimensions in high current density areas and insufficient silver deposit or plating at recessed surfaces. Although the insufficient and irregular silver thickness resulting from electroplating causes the Q Factor to be less than desired, the silver deposit conductance is still quite good and in spite of these difficulties generally provides a better overall Q Factor for the component than if no silver plating is provided.

The problems with non-uniform silver deposit thickness on complex structures resulting from electroplating can be overcome if the deposit is made by electroless or autocatalytic silver deposition. Electroless or autocatalytic silver plating is capable of depositing a silver layer uniformly over any geometry and is especially well suited for plating passive microwave components.

Although electroless silver technology is well established, silver electroless plating has not become a commercial technology because the plating baths tend to spontaneously decompose forming silver particles throughout the solution. This decomposition causes loosely adherent, very fine silver metal particles to be deposited roughly on the plating surface at some unknown time during plating. The result is an unacceptable microwave silver deposit. This plating bath instability tendency can be slightly, but not sufficiently, decreased by adjustment of the solution concentrations. However, these adjustments lower the silver deposition rate to 0–3 micrometers (μm)/hour compared to about 10 μm/hour for commercial electroless nickel.

One electroless silver solution which finds occasional use is described by F. Pearlstein and R. F. Weightman, "Electroless Deposition of Silver Using Dimethylamine Borane", *Plating*, February 1974, pp. 154–157 and is an aqueous solution containing sodium silver cyanide [$NaAg(CN)_2$], free sodium cyanide (NaCN), sodium hydroxide (NaOH), and dimethylamine borane (DMAB) in the following proportions:

1.83 g/l $NaAg(CN)_2$
1.0 g/l NaCN
1.0 g/l NaOH
2.0 g/l DMAB

This solution above is formulated for maximum plating speed. Thiourea at about 0.5 mg/liter is usually added to this bath to improve stability, but has the detrimental effect of altering the properties of the deposit.

Thus, it would be desirable to provide a process for the electroless plating of silver in which the plating bath or solution is stabilized while adequate deposition rates and plating characteristics are maintained to provide desired uniform metal deposition on passive microwave components and other substrates having complex structures where uniform plating thickness and quality is required.

Various different plating surface textures are desirable depending upon the particular application for which the plated surface is to be used. For example, a smooth silver deposit is usually desirable in certain critical applications such as microwave waveguide components to decrease signal losses, or optical devices and bearings to improve performance. In other situations, it is desirable to provide a plating surface which is rough or dendritic to allow adhesion of various plastics or other materials to the plated surface.

It would be desirable to provide an electroless silver plating process in which the physical characteristics of the deposited plating can be varied accurately and conveniently to provide desired surface textures.

SUMMARY OF THE INVENTION

In accordance with the present invention, a process and system are provided wherein the stability of the autocatalytic silver plating bath is variably controlled to allow desired silver deposition rates during electroless plating while maintaining the stability of the silver solution when the solution is not in contact with the substrate to be plated. Further, the present invention provides a convenient and useful means for varying and controlling the physical characteristics and texture of the plated surface to produce a variety of plating surface textures ranging from smooth to rough.

The present invention is based on the discovery that the stability of the autocatalytic silver plating solution, the rate of electroless plating and the characteristic of the resulting silver plated layer can be controlled by varying the oxygen content of the plating solution. An active silver plating solution which is autocatalytic, unstable, and capable of electroless silver plating at a relatively high rate is continually removed from the plating zone or bath and is exposed to oxygen or an oxygen-containing gas to increase the oxygen content of the bath to a predetermined level. The resulting high oxygen content plating solution is stable and does not decompose. However, this stable solution was found to be not only stable, but also passive i.e., the rate of plating is very low. In accordance with the present invention, the passive and stabilized solution is passed through a scrubber, prior to recycling back to the plating zone or bath, to remove a predetermined amount of oxygen from the stabilized solution to provide the desired activity or plating rate for the solution as it flows through the plating zone.

When the plating bath parameters such as the residence time of solution in the plating zone, solution temperature, and solution composition are kept constant, the present invention provides a convenient means to vary and control the activity (i.e., the plating rate) of the silver plating solution by controlling the oxygen content of the plating bath. Decomposition of the bath is also reduced because the high level of oxygen in the silver solution when it is not in the plating zone stabilizes the bath and increases its useful life. An additional feature is that the character of silver electroless plating can be controlled by varying the oxygen content of the solution. When all other plating parameters are the same, the partially deoxygenated silver plating solution provides a relatively smooth plating finish, whereas a relatively rough plating finish is produced by plating with a plating solution that is substantially completely deoxygenated or a solution which is high in oxygen content.

The above-discussed and many other features and attendent advantages of the present invention will become apparent as the invention becomes better understood by reference to the following detailed description when considered in conjunction with the accompanying drawings.

DETAILED DESCRIPTION OF THE INVENTION

The present invention is utilized in connection with electroless or autocatalytic silver plating process. Although numerous different electroless silver plating solutions are possible, the preferred electroless silver solution is an aqueous solution containing silver cyanide (AgCN), sodium cyanide (NaCN), sodium hydroxide (NaOH) and dimethylamine borane (DMAB). Typical electroless silver plating baths useful in practicing the present invention have the following preferred approximate composition:

0.67 g/l AgCN
0.745 g/l NaCN
0.75 g/l NaOH
1.0 g/l DMAB

Increasing the NaOH, DMAB, AgCN, or NaCN concentrations significantly beyond the above-indicated levels results in marked bath instability. Also, decreasing the NaCN concentration destabilizes the plating solution. The AgCN and NaCN combine in solution to form sodium silver cyanide [$NaAg(CN)_2$]. During the plating process, the latter is reduced to metallic silver by the dimethylamine borane, which is oxidized to dimethylamine and sodium borate.

Figure 1:
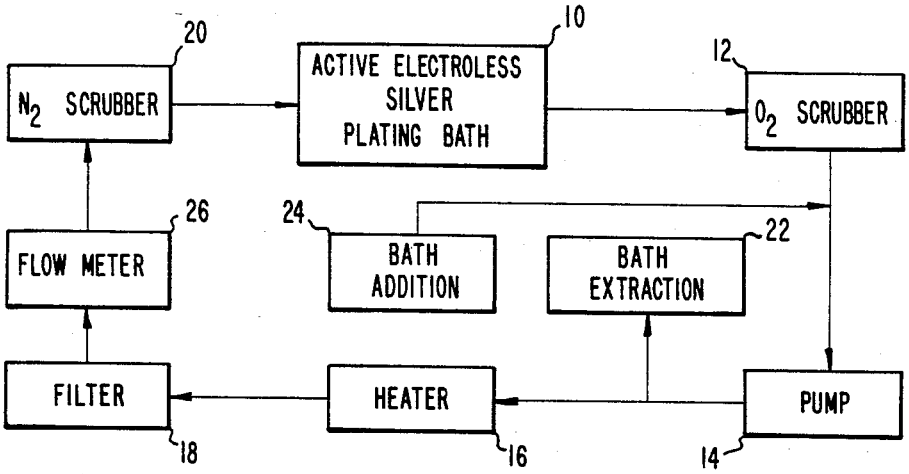
FIG. 1 is a schematic representation of an exemplary process and system in accordance with the present invention.

Referring now to FIG. 1, a schematic representation of an exemplary preferred process in accordance with the present invention is set forth. The system basically includes a plating bath or zone 10, oxygen scrubber 12, pump 14, a temperature regulation device such as heater 16, filter 18 for removing contaminants from the solution, and nitrogen scrubber 20. The system is especially well-suited for the electroless silver plating of microwave waveguides wherein the plating solution is passed through the cavity of the waveguide at a known constant rate. Alternatively, waveguides or other substrates to be plated may be placed in an open plating tank, with the plating solution being recycled through the tank at a constant known rate. Preferably, when plating waveguides, a closed loop arrangement, in which the plating solution contacts only the inside cavity of the waveguide, is preferred, since the open loop system utilizing a plating tank presents a greater danger of spontaneous decomposition due to external contaminants which may enter the plating tank. For the purposes of this description, the zone defined by the plating bath in an open liquid loop system or the internal surface of a microwave waveguide in a closed liquid loop system will both be referred to as plating zones. In addition, the electroless silver solution which is capable of depositing silver on the substrate is referred to herein as the "active" plating solution, whereas the silver solution which has been oxygenated and is not capable of depositing silver on the substrate is referred to herein as the "stabilized silver solution".

The plating solution is removed from the plating zone 10, for example, through an overflow weir, and passed to an oxygen scrubber 12. In oxygen scrubber 12, an oxygen-containing gas, such as air or pure oxygen, is bubbled, diffused or otherwise intimately contacted with the plating solution at a controlled flow rate provided by a flow meter (not shown). The plating solution is contacted with a sufficient amount of oxygen-containing gas for a sufficient time and at a sufficient temperature to raise the dissolved oxygen level in the solution to approximately 8–15 parts per million (ppm). The oxygen content of the solution may be measured using a commercially available dissolved oxygen meter, such as available from Yellow Springs Instruments of Ohio. Generally, when excess oxygen is available, aeration of the plating solution with air saturates the solution with 8 ppm oxygen in a relatively short time (e.g. a few seconds). It is believed that the oxygen reacts with silver which would otherwise deposit from solution to keep the silver oxidized to the $Ag(CN)_2^-$ anion by the following reaction:

$$2Ag + 4CN^- + \tfrac{1}{2}O_2 + H_2O \rightarrow 2Ag(CN)_2^- + 2OH^-.$$

This reaction is kinetically rapid and results in the stabilization or inactivation of the solution to prevent autocatalytic decomposition. The homogeneous reaction of oxygen and reducing agents such as DMAB is kinetically slow at sufficiently low temperatures. The result is a stabilized or passive silver solution which can be maintained outside the plating zone up to a week without decomposing.

The oxygenated silver solution is drawn from oxygen scrubber 12 to pump 14 for recycling back to the plating zone 10. Excess plating solution or undesirable contaminants may be removed from the system by being passed to a bath extraction unit 22, for example, through an overflow weir. During operation of the system, both the silver-containing compound and DMAB will be consumed as silver is plated onto the substrate. Accordingly, the necessary additional chemicals are added to the solution as shown schematically at 24 in order to maintain the solution make-up at initial formulation levels. The additional chemicals are added just after the $O_2$ scrubber in order to maintain the stability of the plating solution and to allow the solution with the added chemicals to be heated, filtered, and treated as shown in FIG. 1 prior to entering the plating zone.

Under the force from pump 14, the inactivated solution is passed through a temperature controller, such as heater 16, in order to insure that the plating solution is maintained at the desired temperature for plating. Plating solution temperatures are preferably between 20° C. and 80° C., and more preferably, between 40° C. and 50° C.

The stabilized silver solution at the desired temperature is then passed through filter 18. The filter 18 may include any conventional filter element having pore sizes sufficient to remove from the flowing solution free floating catalytic particles or nuclei, such as colloidal silver, foreign particles, minute loosely adherent activation treatment residuals, and silver and other metal particles. Preferably the filter will remove any particle having a particle size greater than one micron. Removal of these particles from the system prior to recycling back to the plating zone 10 is important, since these particles act as catalytic nuclei which can ultimately cause decomposition and unacceptable silver deposits when the plating solution is reactivated.

The trapped particles in the filter do not cause continued silver deposition and do not grow in size because the oxygenated stabilized solution passing through the filter tends to redissolve the silver particulates to their original ionic state. This effect not only increases the useful life of the plating solution but also reduces the depletion of silver in the plating system due to formation of colloidal silver and silver metal particles which form in parts of the system other than on the substrate to be plated.

The stabilized solution is passed, by pumping, from filter 18 through flow meter 26, which is preferably provided to monitor and control the flow of solution through the plating zone 10. The stabilized solution is passed through flow meter 26 to a nitrogen scrubber 20 in which the stabilized solution is contacted with nitrogen gas provided at a controlled flow rate. Other gases besides nitrogen may be used, such as argon or helium, so long as they provide displacement of oxygen from the stabilized solution and do not interact with the solution to adversely affect the solution plating characteristics. Nitrogen, however, is preferred.

Figure 2:
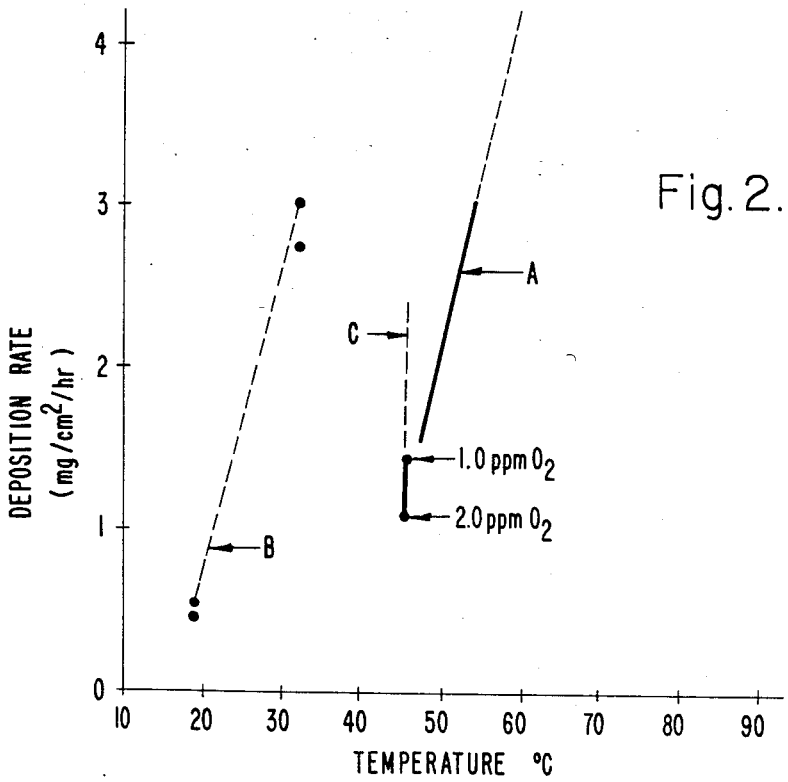
FIG. 2 is a graph showing the relationship between oxygen present in the plating bath and the deposition rate for an electroless silver plating solution.

The amount of nitrogen which is bubbled or otherwise diffused through the stabilized solution, the residence time of the stabilized solution in the nitrogen scrubber 20 and the solution temperature are controlled to provide varying degrees of dissolved oxygen removal. The degree of oxygen removed depends upon the desired plating rate and the particular plating texture desired. When high plating rates are desired, it is preferred to provide excess nitrogen in scrubber 20 to thereby displace almost all of the dissolved oxygen present in the stabilized solution to provide a highly activated plating solution. When slower plating rates are desired, the stabilized solution is only partially scrubbed to remove only a portion of the dissolved oxygen to provide a plating solution with a lower activity. FIG. 2 presents curves showing the relationship between deposition rate and oxygen content of the solution. Curve A of FIG. 2 indicates the deposition rate for an electroless silver plating solution with maximum dissolved oxygen; while Curve B shows the deposition rate for a silver solution with minimum dissolved oxygen; and Curve C shows the deposition rate for a silver solution with a controlled amount of oxygen, namely 1.0 ppm and 2.0 ppm as indicated. The stable state of these solutions is indicated by a solid line, while a dashed line indicates an unstable state, as discussed in further detail herein below.

Other electroless silver plating parameters in addition to oxygen content which affect the plating rate, the amount of silver deposited and deposit texture include: residence time of the plating solution in the plating zone, temperature of the plating solution, and the formulation of the plating solution. When these other parameters are maintained constant, the deposition rate for the electroless silver plating is increased by decreasing the amount of oxygen in the active plating solution as it leaves the nitrogen scrubber 20. The high deposition rate results in a silver plating layer having a rough texture. Conversely, in order to lower the plating rate and provide a smoother plating texture, the nitrogen scrubber 20 is operated to only partially remove the dissolved oxygen present in the stabilized solution to provide a plating solution with reduced activity.

Preferably, when maximum oxygen removal is provided in nitrogen scrubber 20, the flow rate of the plating solution through the plating zone 10 is sufficiently rapid so that little or no undesirable decomposition of the active plating solution occurs prior to the solution being passed back to the oxygen scrubber 12 for deactivation. As the oxygen level of the active plating solution is increased, the residence time of the solution in the plating zone may accordingly be increased if desired. Residence times should still be kept short enough to prevent decomposition of the bath in the plating zone 10. Preferred residence times can vary from 1 second to 5 minutes.

Suitable substrates upon which electroless silver may be deposited include silver foil, activated glass, and plastic. The glass and plastic are initially activated by immersion in tin chloride ($SnCL_2$) solution, followed by immersion in a silver-ammonia solution. Copper, brass and electroless nickel are also suitable substrates, but they must first be treated with a palladium chloride dip, followed by an electroless silver strike, to assure good adhesion. Invar may be plated provided that an intermediate layer of electroless nickel is applied first. Typical solutions have the following compositions:

a. Palladium chloride for copper or brass
$PdCl_2.2H_2O$ 0.1 g/l "Dilute"
HCl 10 ml/l
b. Palladium chloride for electroless nickel $PdCl_2.2H_2O$ 1.0 g/l "Strong"
HCl 100 ml/l
c. Electroless silver strike
AgCN 0.335 g/l
NaCN 1.123 g/l
NaOH 1.50 g/l
DMAB 4.0 g/l The strike solution is designed to cover the substrate surface with silver quickly by electroless means while simultaneously minimizing the tendency for immersion silver deposits to form. This technique assures good adhesion of the silver layer to the substrate. The strike solution should be stabilized with about 3–8 ppm of dissolved oxygen, and operated at about 45° C.

In the Examples described below, copper alloy or silver was used as the deposition substrate. The copper alloy used in Examples 1 to 6 contained 95% copper and 5% zinc. The copper alloy substrates were cleaned as follows:

1. Soaked 5 minutes at 120° F. in Shipley Neutraclean solution.
2. Rinsed in water.
3. Soaked 5 minutes at room temperature in a solution of 1 g/l NaCN and 1 g/l NaOH.

The silver substrates used in Examples 7 to 9 were cleaned as follows:

1. Soaked 5 minutes at room temperature in Alconox solution, from Alconox Inc.
2. Rinsed in water.
3. Soaked 1 minute in room temperature solution of 10 g/l NaCN and 10 g/l NaOH.

The substrates were weighed before and after electroless silver deposition to determine deposition rate and thickness. The plateable area on each substrate was about 1 square inch. The experimental setup was similar to that shown in FIG. 1.

The plating solution formulation for each example is set forth in Table I. For Examples 1–2 and 5–6, new unused plating solution was used. For Examples 3 and 4, the same solution used in Examples 1 and 2 was used, except that 1 g/l DMAB was added. In Examples 7–9, the solutions used were either new or had only slight use.

TABLE I

| PLATING SOLUTION FORMULATIONS | | | | |
|---|---|---|---|---|
| Constituent | Ex. 1 & 2 | Ex. 3 & 4 | Ex. 5 & 6 | Ex. 7, 8 & 9 |
| AgCN (g/l) | 1.2 | 1.1 | 1.34 | 0.67 |
| NaCN (g/l) | 1.35 | 1.3 | 1.49 | 0.75 |
| NaOH (g/l) | 0.68 | 0.6 | 0.75 | 0.75 |

TABLE I-continued

| PLATING SOLUTION FORMULATIONS | | | | |
|---|---|---|---|---|
| Constituent | Ex. 1 & 2 | Ex. 3 & 4 | Ex. 5 & 6 | Ex. 7, 8 & 9 |
| DMAB (g/l) | 1.8 | 2.0 | 2.9 | 1.0 |

The system variables for the nine examples are set forth in Table II. Examples 1–4 were designed to provide complete oxygen removal from the inactivated plating solution by the nitrogen scrubber 20, while Examples 5 and 6 involved only partial deoxygenation of the inactivated solution in the nitrogen scrubber 20. Examples 7, 8 and 9 were designed to closely monitor the oxygen levels in both the plating zone (10) and in the oxygen scrubber (12). The characteristics of the silver deposits formed in Examples 1–9 are set forth in Table III.

TABLE II

| SYSTEM VARIABLES | | | | | | | |
|---|---|---|---|---|---|---|---|
| Example No. | Pump Flow Rate (ml/min) | $N_2$ Flow Rate (ml/min) | $O_2$ Flow Rate (ml/min) | Oxygenated Solution Volume (ml) | Deoxygenated Solution Volume (ml) | Deposition Temp. (°C.) | Deposition Time (Hours) |
| 1 | 340 | 605 | 259 | 550 | 550 | 18 | 1 |
| 2 | 340 | 605 | 259 | 550 | 550 | 18 | 2 |
| 3 | 340 | 605 | 259 | 575 | 575 | 50 | 1 |
| 4 | 340 | 605 | 259 | 575 | 575 | 50 | 2 |
| 5 | 865 | 340 | 390 | 600 to 800 | 400 to 200 | 40 | 1 |
| 6 | 865 | 340 | 390 | 600 to 800 | 400 to 200 | 40 | 2 |
| 7 | 500 | 250 | 300* | 500 | 9,500 | 45 | 1.1 |
| 8 | 500 | 350 | 500* | 500 | 9,500 | 45 | 1 |
| 9 | 1000 | 300 | 125 | 500 | 9,500 | 45 | 1 |

*Air used instead of $O_2$

TABLE III

| SILVER DEPOSIT CHARACTERISTICS | | | | |
|---|---|---|---|---|
| Example No. | Average Ag Deposit Thickness* (μin) | Deposition Rate** ($mg/cm^2/hr$) | Deposit Characteristics | Adhesion |
| 1 | negligible | negligible | Silver immersion deposit is visible. | Poor |
| 2 | negligible | negligible | Silver immersion deposit is visible. | Poor |
| 3 | 239 | 6.37 | Rough, spongy deposit. | Good |
| 4 | 388 | 5.17 | Rough, spongy deposit. | Good |
| 5 | 30 | 0.81 | Matte, silver deposit. | Poor |
| 6 | 40 | 0.53 | Matte, silver deposit. | Poor |
| 7 | 43 | 1.16 | Matte, slight roughness | Good |
| 8 | 56 | 1.43 | Matte, fairly rough | Good |
| 9 | 54 | 1.30 | Matte, quite smooth | Good |

*Determined from weight of deposit.
**Determined from deposit thickness.

As is shown in Table III, the degree of oxygen removal or scrubbing in nitrogen scrubber 20 provides a convenient means not only for controlling the deposition rate, but also for controlling the texture of the deposited layer. In Examples 3 and 4 where the nitrogen flow rate is high (i.e., producing high oxygen removal), the electroless silver deposition rate is correspondingly high (5–6 $mg/cm^2/hr$) and the resulting deposit has a rough texture. In Examples 5 and 6 where the nitrogen flow rate is reduced (i.e., producing only partial oxygen removal), the silver deposition rate is correspondingly reduced (0.5 to 0.8 $mg/cm^2/hr$) and the resulting deposit has a smooth texture. The oxygen levels in Examples 7–9 are given in Table IV.

TABLE IV

| Example No. | OXYGEN LEVELS Dissolved $O_2$ In Deposition chamber | In Stabilized chamber |
|---|---|---|
| 7 | 2.0 ppm | 5.0 ppm |
| 8 | 1.0 ppm | 5.0 ppm |
| 9 | 2.0 ppm | 10.0 ppm |

Examples 7 and 8 quantify the smoothness and plating rate with respect to dissolved oxygen, with higher oxygen levels giving a smoother deposit. A comparison of Examples 7 and 9 indicates the effect of solution flow rate. The residence time of the active solution (solution volume/flow rate) for Example 9 is half that of Example 7 (½ minute versus 1 minute). A short residence time allows less time for decomposition particles to form, resulting in a smoother deposit surface and contributing to overall solution life. Hence, Example 9 is the preferred embodiment for producing smooth deposits for microwave applications.

As is apparent from the above examples, the desired deposition rate and surface texture can be readily varied and closely controlled by controlling the degree of oxygen removal in the nitrogen scrubber. The amount of oxygen required in the plating solution to produce a plated silver layer of desired characteristics can readily be determined by varying the amount of oxygen in the solution in successive experiments and examining the quality of the corresponding silver deposits.

In addition other related physical characteristics of the silver layer in addition to surface texture which can be controlled by the process of the present invention are density, grain size, crystal orientation, adhesion properties, and purity, as well as electrical conductivity. Furthermore, regulation of the oxygen content of the plating solution in the plating zone 10 is important in preventing spontaneous decomposition of the plating solution. As shown in the graph depicted in FIG. 2, Curve A, an electroless silver plating solution with maximum dissolved oxygen is stable even at relatively high temperatures of 45° C. to 55° C. as indicated by a solid line, while Curve B of FIG. 2 shows that an electroless silver plating solution with minimum dissolved oxygen is unstable even at low temperatures down to 15° C., as indicated by dashed lines. Curve C of FIG. 2 provides data for an electroless silver plating solution containing a controlled amount of oxygen and shows that such solutions are unstable at oxygen concentrations of less than 1.0 ppm. By treating the plating solution with oxygen in accordance with the present invention as it leaves the plating zone 10, the stability of the solution is maintained while it is recycled, stored or otherwise handled outside of the plating zone. Solutions have been maintained for up to one week using the oxygen levels indicated in Example 9.

Adhesion of the silver deposits was tested by applying masking tape to the deposit and then pulling the tape off. Adhesion was good on Examples 3, 4, 7, 8 and 9, as indicated in Table III. Adhesion was poor on the remaining samples, presumably due to the formation of an immersion silver deposit before electroless deposition could begin. Subsequent samples for which the palladium chloride dips and electroless silver strike were developed, have shown good adhesion.

Having thus described exemplary embodiments of the present invention, it should be noted by those skilled in the art that the within disclosures are exemplary only and that various other alternatives, adaptations and modifications may be made within the scope of the present invention. Accordingly, the present invention is not limited to the specific embodiments as illustrated herein and is only limited by the following claims.

What is claimed is:

1. A process for electroless plating to deposit a layer of silver onto a substrate, said process comprising the steps of:

(a) passing an active electroless silver plating solution capable of autocatalytically plating said silver onto a substrate, through a plating zone wherein said active electroless silver plating solution is maintained at a sufficient temperature and resides within said plating zone for a sufficient time to provide autocatalytic plating of said silver onto said substrate located within said plating zone to form a silver plating layer on said substrate;

(b) removing said active electroless silver plating solution from said plating zone and exposing said active electroless silver plating solution to a sufficient amount of an oxygen-containing gas to provide a controlled level of oxygen therein and thereby provide a stabilized silver solution;

(c) passing said stabilized silver solution to a scrubber zone;

(d) exposing said stabilized silver solution in said scrubber zone to a scrubber gas capable of displacing said oxygen from said stabilized silver solution for a sufficient time to reduce the amount of said oxygen in said stabilized silver solution to a level sufficient to regenerate said active electroless silver plating solution; and (e) recycling said active electroless silver plating solution from said scrubber zone to said plating zone wherein the rate of autocatalytic plating and the physical characteristics of said silver plating layer are controlled by varying the amount of said oxygen removed from said stabilized silver solution in said scrubber zone.

2. A process according to claim 1 wherein said scrubber gas is a gas essentially containing gases selected from the group consisting of nitrogen, argon, and helium.

3. A process according to claim 1 wherein said stabilized silver solution incorporates about 8 to 15 parts per million dissolved oxygen.

4. A process accordingly to claim 1 wherein said electroless silver plating solution consists essentially of an aqueous solution containing: approximately 0.67 grams/liter AgCN, 0.75 grams/liter NaCN, 0.75 grams/liter NaOH and 1.0 grams/liter dimethylamine borane.

5. A process according to claim 1 wherein a predetermined amount of said oxygen in said stabilized silver solution is removed in said scrubbing zone.

6. A process according to claim 1 wherein the temperature of said active electroless silver plating solution in said plating zone is between about 20° C. and 80° C.

7. A process according to claim 6 wherein the residence time of said active electroless silver plating solution in said plating zone is between about 1 second and 5 minutes.

8. An electroless plating system adapted for the autocatalytic deposition of a silver layer onto a substrate comprising:

(a) a vessel defining a plating zone through which is passed an active electroless silver plating solution capable of autocatalytically plating said silver onto a substrate, said vessel including an inlet and an outlet;

(b) means associated with said vessel outlet for removing said active electroless silver plating solution from said plating zone;

(c) means for exposing said active electroless silver plating solution removed from said plating zone to an oxygen-containing gas to provide a controlled level of oxygen in said active solution and thereby produce a stabilized silver solution;

(d) scrubber means for exposing said stabilized silver solution to a scrubber gas capable of displacing said oxygen from said stabilized silver solution to reduce the amount of said oxygen in said stabilized silver solution to produce said active electroless silver plating solution;

(e) means for transferring said stabilized silver solution from said means for exposing to said scrubber means; and (f) means for recycling said active electroless silver plating solution from said scrubber means to said inlet of said vessel for electroless plating of said silver onto said substrate wherein the rate of autocatalytic silver plating and the physical characteristics of said silver layer are controlled in part by varying the amount of said oxygen removed from said stabilized silver solution by said scrubber means.

9. An electroless silver plating system according to claim 8 further including filter means for removing particulate material from said stabilized silver solution, said filter means being located after said means for exposing said active electroless silver plating solution and before said scrubber means.

10. An electroless silver plating system according to claim 8 further including means for controlling the temperature of said active electroless silver plating solution.

* * * * *